US006637710B2

(12) United States Patent
Yaphe et al.

(10) Patent No.: US 6,637,710 B2
(45) Date of Patent: Oct. 28, 2003

(54) FIXTURE SUSPENSION BRACKET ASSEMBLY

(75) Inventors: Howard Yaphe, Ville St-Laurent (CA); Pascal Toupin, Cornwall (CA)

(73) Assignee: Canlyte Inc., Quebec (CA)

( * ) Notice: Subject to any disclaimer, the term of this patent is extended or adjusted under 35 U.S.C. 154(b) by 0 days.

(21) Appl. No.: 09/965,433

(22) Filed: Sep. 27, 2001

(65) Prior Publication Data

US 2002/0060280 A1 May 23, 2002

(30) Foreign Application Priority Data

Sep. 28, 2000 (CA) ..... 2321341

(51) Int. Cl.[7] ..... A47H 1/10; A47F 7/14

(52) U.S. Cl. ..... 248/317; 248/342; 248/343; 248/906

(58) Field of Search ..... 248/317, 58, 343, 248/228.1, 228.7, 342, 906, 228.8, 72, 67, 344, 340; 52/484, 506.07, 39, 28

(56) References Cited

U.S. PATENT DOCUMENTS

| | | | | | |
|---|---|---|---|---|---|
| 2,000,241 | A | * | 5/1935 | Mangin | 240/85 |
| 3,066,903 | A | * | 12/1962 | Tinnerman | 248/300 |
| 3,066,904 | A | * | 12/1962 | Cook et al. | 248/342 |
| 3,599,921 | A | * | 8/1971 | Cumber | 52/484 |
| 3,612,461 | A | * | 10/1971 | Brown | 248/317 |
| 3,652,780 | A | * | 3/1972 | Wilson | 174/45 R |
| 3,843,086 | A | * | 10/1974 | Ptak | 248/317 |
| 4,101,103 | A | * | 7/1978 | Mooney et al. | 248/58 |
| 4,135,692 | A | * | 1/1979 | Ferguson | 248/317 |
| 4,958,792 | A | * | 9/1990 | Rinderer | 248/74.2 |
| 5,533,696 | A | * | 7/1996 | Laughlin et al. | 248/74.2 |
| 5,667,181 | A | * | 9/1997 | van Leeuwen et al. | 248/343 |
| 6,260,810 | B1 | * | 7/2001 | Choi | 248/65 |
| 6,345,800 | B1 | * | 2/2002 | Herst et al. | 248/342 |

* cited by examiner

*Primary Examiner*—Kimberly Wood
(74) *Attorney, Agent, or Firm*—Jeffrey A. Haeberlin; Middleton Reutlinger

(57) ABSTRACT

A fixture bracket suspension assembly is mounted directly to a drop ceiling runner. The runner has a stem and a base wall with a pair of flanges extending out from the stem in a generally inverted T shape. The flanges are adapted to support ceiling tiles and the stem has cross member positioning slots located along its length. The bracket assembly comprises a screw and a bracket. The screw has a head portion and a stem portion for supporting a suspension wire adapted to be mounted to a fixture. The bracket has a base plate with an opening through which the screw stem portion passes. The base plate has a top surface for supporting the screw head adjacent the base wall of the runner. The bracket has two pair of spaced apart opposing legs. Each pair of legs has a shape that conforms to the shape of the flanges and stem of the runner and are adapted to bend at respective joints with the base plate wrapping around the runner to present minimal encumbrance to the runner and to support the base plate and the screw below the runner. Each of the pairs of legs has end portions with a locking tab and recess. One of the legs of each pair has a tab member adapted to pass through one of the positioning slots in the runner to secure the bracket member from movement along the runner. The bracket assembly is a simple and direct drop ceiling suspension system for linear lighting fixtures eliminating anchoring of the linear fixtures above the runner of the drop ceiling.

18 Claims, 5 Drawing Sheets

FIXTURE SUSPENSION BRACKET ASSEMBLY

FIELD OF THE INVENTION

The present invention relates to a fixture suspension bracket assembly for suspending a lighting fixture directly from a drop ceiling assembly.

BACKGROUND OF THE INVENTION

Modular suspended linear fixtures are typically assembled in place by connecting and mounting individual modules. Typical linear fixtures are suspended from an overhead structure above a drop ceiling that is also suspended from the overhead structure.

The linear fixtures support linear fluorescent lighting systems such that the lighting fixtures may radiate light upwardly against the drop ceiling or downwardly towards the work area. Typically these assemblies are suspended at heights of 7 ft. or more from the floor and the installer has to work above the drop ceiling to install connections that connect the fixtures to the ceiling structure which may involve driving securing bolts directly into ceiling joists or through ceiling framework. In any event, the installer has to work above the drop ceiling resulting in movement of lay in tiles. Further, when the fixtures are being installed, the placement of the fixtures is limited to where there may be an upper support beam in the ceiling. This limitation becomes more apparent when the working space is redesigned and lighting patterns have to be changed in the workspace.

Clearly there is a need to improve the suspension of these fixtures that improves flexibility in deployment and re-deployment of the fixtures to accommodate lighting in the work space and does not require the installers to work above the drop ceiling.

SUMMARY OF THE INVENTION

The present invention relates to a fixture suspension bracket assembly for suspending a lighting fixture directly from a drop ceiling assembly. In particular, the suspension bracket supports a screw and a wire to suspend a linear fixture. The suspension bracket has a base plate and at least one pair of legs extending from bendable relative to the base plate. The legs are adapted to bend about a runner to mount the bracket directly to the runner with the base plate below the drop ceiling runner.

In accordance with an aspect of the present invention there is provided a fixture bracket suspension assembly mounted directly to an inverted T shaped drop ceiling tile supporting member. The assembly comprises a screw having a head portion and a stem portion for supporting a suspension wire adapted to be mounted to a fixture. The assembly comprises a bracket having a base plate with an opening through which the stem portion of the screw passes. The base plate has a top surface for supporting the head of the screw. The bracket has at least one pair of bendable legs adapted to be wrapped around the runner to present minimal encumbrance to the runner and to support the base plate and the screw below the runner.

BRIEF DESCRIPTION OF THE DRAWINGS

The invention will be better understood and its advantages will become more apparent to those skilled in the art by reference to the following drawings, in conjunction with the accompanying specification, in which.

DETAILED DESCRIPTION OF EMBODIMENTS

Figure 1:
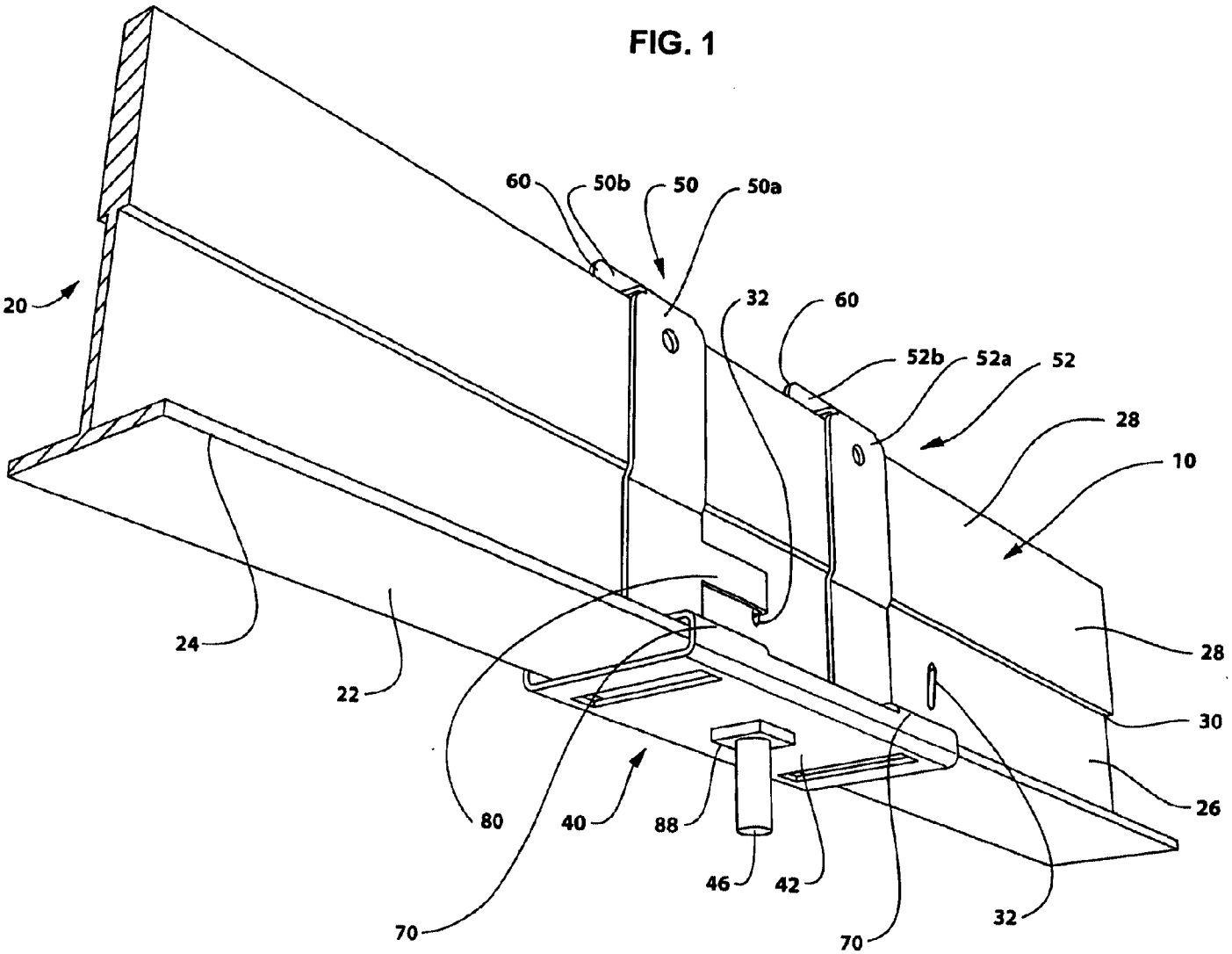
FIG. 1 is a perspective view of the fixture bracket suspension assembly shown mounted to a drop ceiling runner.
Figure 2:
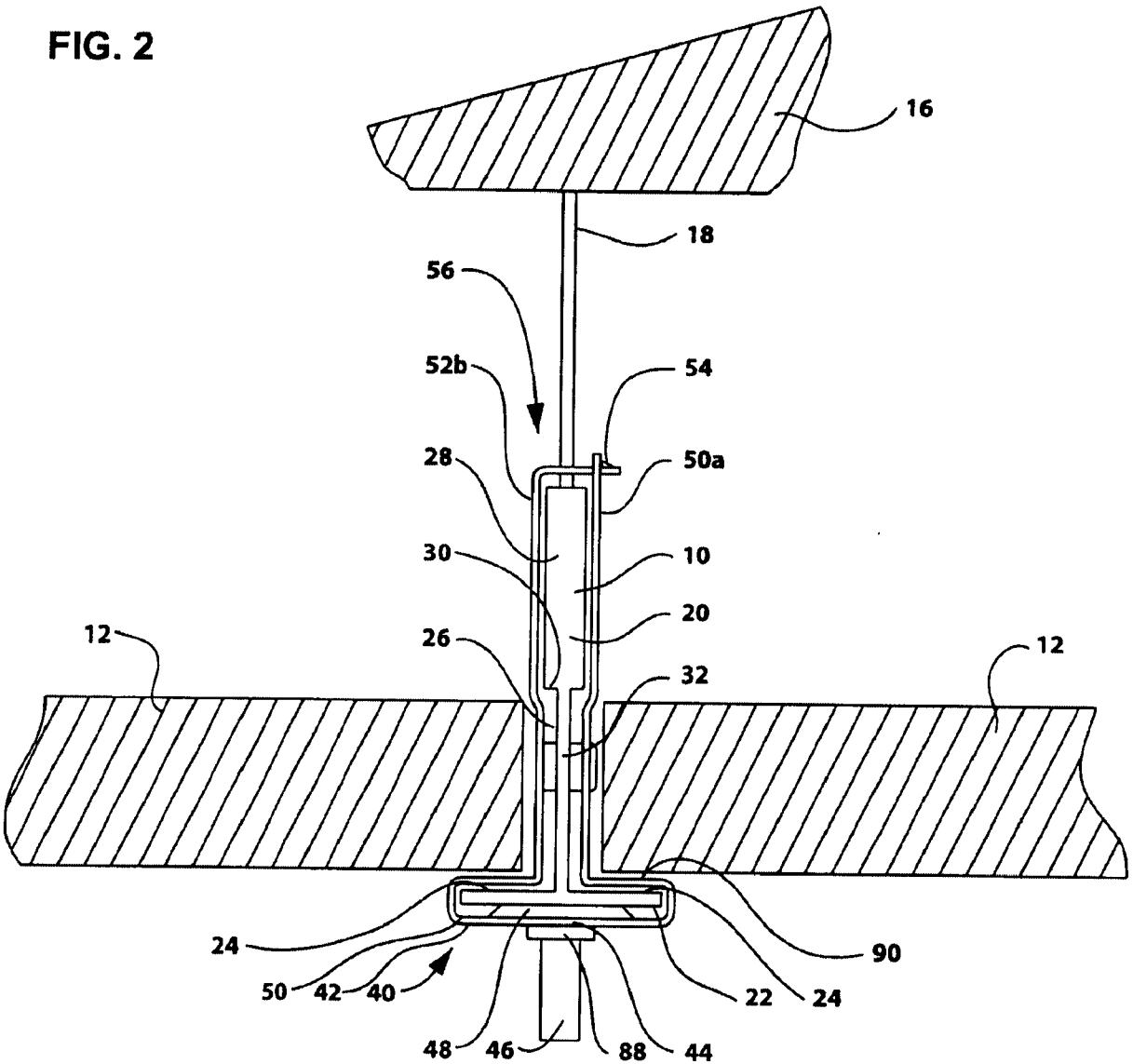
FIG. 2 is an end sectional view of FIG. 1.
Figure 3:
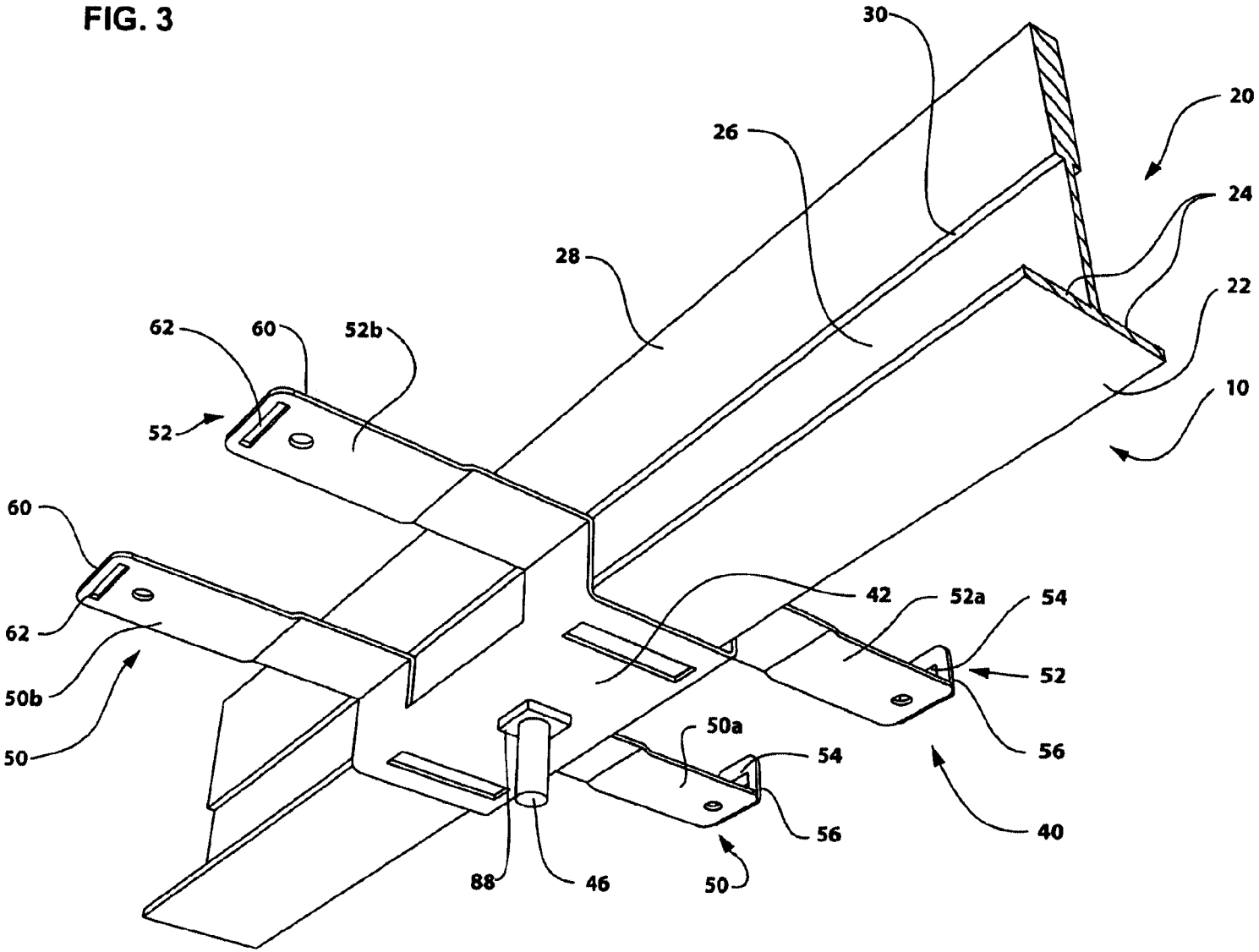
FIG. 3 is a perspective view showing the fixture bracket suspension assembly in the process of mounting to the runner.
Figure 4:
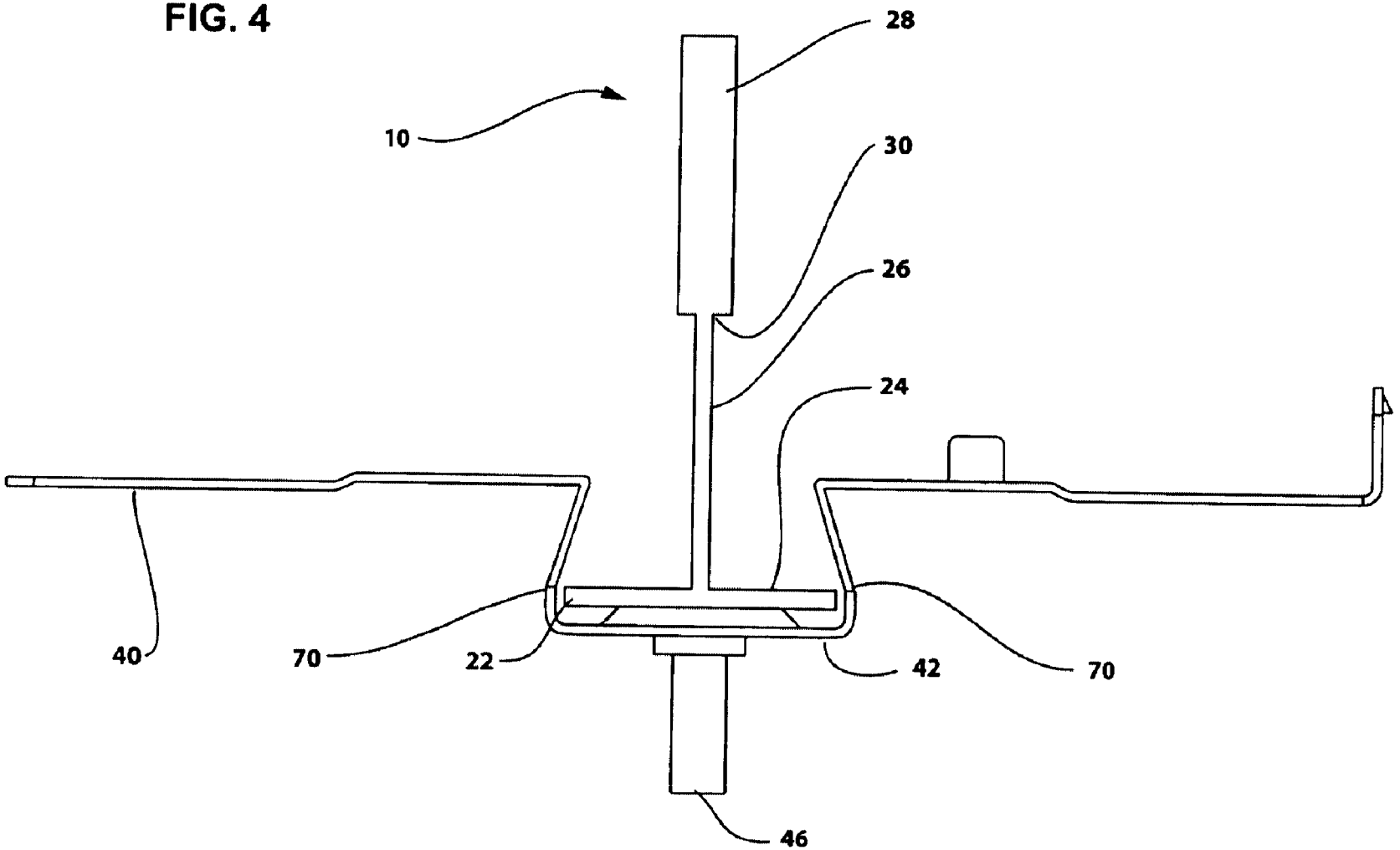
FIG. 4 is a sectional end view of FIG. 3.

Referring to FIGS. 1 through 4, there is shown a runner 10 of a drop ceiling that supports ceiling tiles 12 from a ceiling structure 16 through the use of hanger wires 18 supporting the runner 10. The shape of the runner 10 shown in FIGS. 1 and 2 conforms to a standardized shape utilized in commerce in North America today. It should be understood, however, that the shape of the runner may vary from one particular design to another. Suffice it to say that the overall shape of this runner 10 is typically an inverted T-shaped runner with a stem portion 20 and a base wall portion 22. The base wall portion 22 has opposing flanges 24 on which the ceiling tiles 12 are adapted to fit. The stem of runner 10 is divided into a first portion 26 adjacent the flanges 24. The stem also includes an end portion 28 which is further away from the flanges 22. The thicknesses of the inner stem 26 is chosen so that the outer stem portion 28 may provide bottom edge surfaces 30 against which the ceiling tiles may be laid in place.

The upper stem portion 28 has a series of slots (not shown) through which the hanger wire 18 passes to support the runner 10 from the overhead structure 16. The lower or inner stem portion 26 has a series of apertures 32 which are in effect cross member positioning recesses 32 for receiving protrusion ears of the cross member runners to support the cross member runners from the runner 10. The cross member runners also have flange like surfaces as is well known in the art for supporting the edges of the ceiling tile 12. It should be understood that the ceiling tiles 12 are lay in ceiling tiles which may be laid into place on the runners and cross member runners.

In accordance with the present invention there is provided a bracket 40 having a base plate 42 that has an opening 44 (see FIG. 2) through which a screw stem 46 passes. The screw stem 46 is attached to a screw head 48 which is located on the top surface 50 of the base plate 42 adjacent the base wall 22 of runner 10. The screw stem 46 is adapted to be connected in a suitable fashion in a joining relationship with a suspension wire which will extend downwardly of the bracket 42 and the stem 46 to suspend or be attached to a linear lighting fixture.

The bracket 40 further includes two pairs of spaced apart legs generally shown as 50 and 52. The pair of legs 50 comprise leg 50A and leg 50B. The pair of legs 52 comprise leg 52A and leg 52B. Each of the legs 50A and 52A has a locking barb 54 located at the end portion 56 of the leg 50A and 52A. The end portions 60 of legs 50B and 52B have a stamped out slot or locking receiving slot 62. The opposing pair of legs 50 and 52 are bendable about joint 70 adjacent to the base plate 42 so as to wrap the pairs of legs 50 and 52 about the runner 10 and in particular wrap about the stems 26 and 28 of the runner 10. As the pairs of legs 50 and 52 are wrapped about the stems 26 and 28 of the runner, the locking tab or barb 54 passes through receiving slot 62 and locks the end portions 60 and 56 of the legs 52A and 52B or 50A and 50B together.

Leg 50A of the pair of legs 50 has a arm extension 80 with another tab 82 which is fitted into the cross member positioning slot 32. This positively locates the bracket 40 longitudinally along the runner 10 and prevents the bracket 40 from sliding along the runner 10.

The assembly of the bracket 40 onto the runner 10 is easily accomplished by positioning the base plate 42 against the wall surface 22 of the runner 10 and bending the legs 52A and 52B towards each other from an open runner-receiving orientation to a closed runner-engaging orientation to wrap around the stems 26 and 28 of the runner 10 to lock the barb 56 through the slot 62. Similarly, the other pair of opposing legs 52 may be bent to so secure the bracket member 40 to the runner 10. Prior this assembly the screw stem 46 is slid through the base 42 with stern 46 suspended below e runner 10. The stem 46 may be secured iii place by means of a lock nut 88. Once the opposing legs 50 and 52 of the bracket member 40 are bent into position to wrap around the runner 10 as shown substantially in FIG. 2, it can be seen that the shape of the side legs and the overall shape of the bracket member is chosen to conform to the shape of the runner and thereby wrap around the runner. The opposing legs 50 and 52 have a surface portion 90 that rests on to of the flanges 24 of the runner 10 and thereby positively locate the bracket 40 relative to the runner 10 when a weight is suspended from the threaded stem 46 by a wire and fixture. Each leg has a first leg portion being bendable at a respective joint adjacent to the base plate 42 and a second leg portion extending substantially at right angles to the first leg portion, wherein, in the closed runner-engaging orientation the first leg portion engages a corresponding flange portion 24 and is substantially parallel with the flange portion 24 and the base plate 42. Similarly, in the closed runner-engaging orientation, the second leg portion engages the stem portion 20, and the second leg portions are arranged to be locked together in the closed runner-engaging orientation, to form a nested relationship between the legs and the runner.

The present invention provides for an easy to assemble bracket member assembly that can be mounted to the runner of a drop ceiling. Hence the bracket suspension assembly 40 may be attached to the drop ceiling runner by an installer without the installer having to work above the drop ceiling at the overhead support structure 16.

It should be understood that the present invention also provides the advantage of allowing for the bracket assembly 40 to be readily disassembled from it's position on the runner and moved to other runner locations. It is further envisaged that the bracket assembly may also be mounted to a cross member that would support the ceiling tiles 12. Accordingly, when reference is made throughout the disclosure to the use of the bracket 40 being attached to a runner 10 it should be understood that this runner 10 could also include a cross runner member in a drop ceiling for a lay in ceiling tile.

Figure 5:
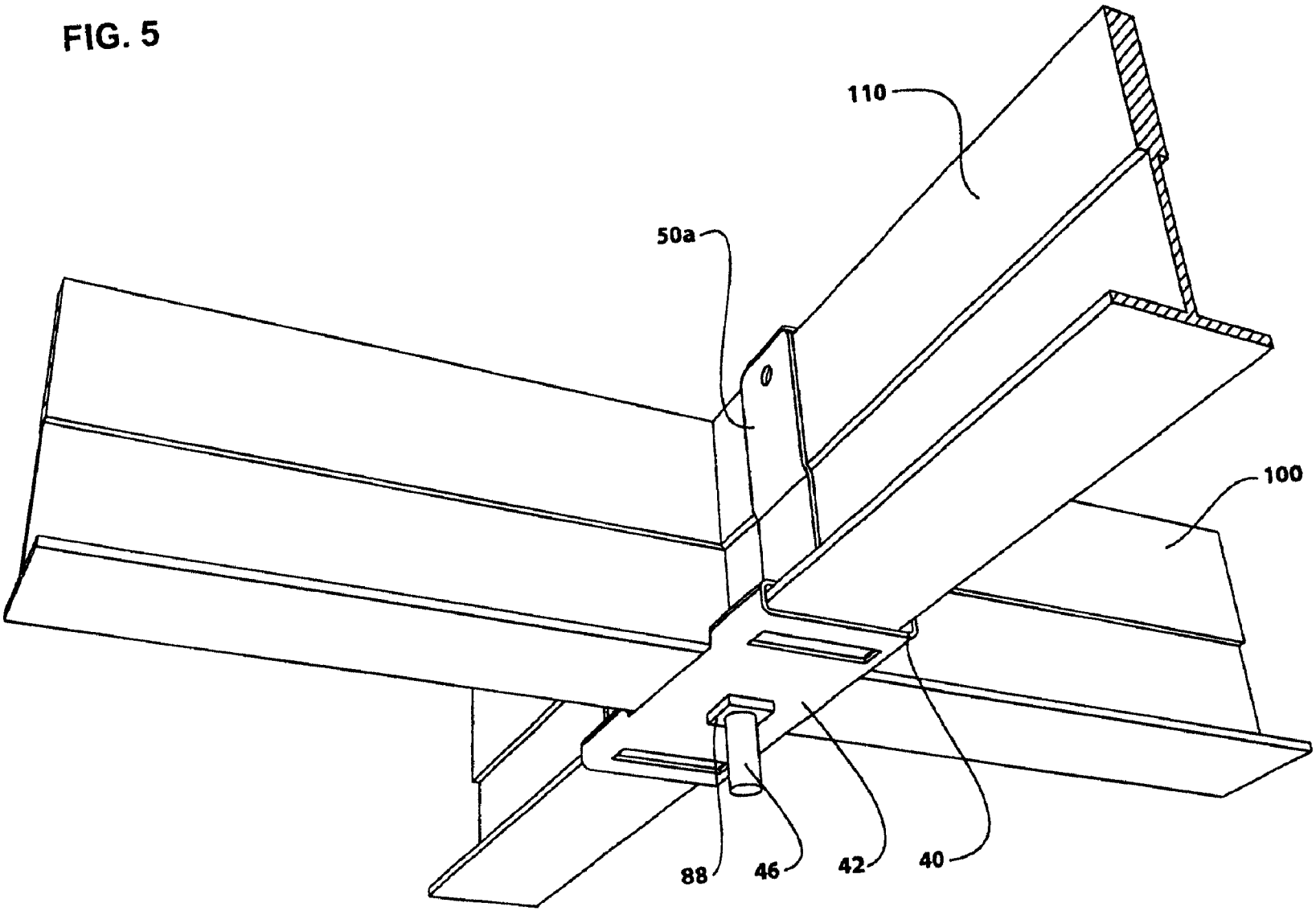
FIG. 5 is a view of the bracket connected to an alternative runner design.

In accordance with another aspect, reference may be had to FIG. 5 wherein the bracket member 40 is shown mounted across two cross runners 100 and 110 used in a drop ceiling.

What is claimed is:

1. A fixture bracket suspension assembly mounted directly to an inverted T shaped drop ceiling runner, the assembly comprising:

a screw having a head portion and a stem portion for supporting a suspension wire adapted to be mounted to a fixture;

a bracket having a base plate with an opening through which the stem portion of the screw passes, the base plate having a top surface for supporting the head of the screw, the bracket having at least one air of bendable legs adapted to be wrapped around the runner to present minimal encumbrance to the runner and to support the base plate and the screw below the runner, the bendable legs having a shape that conforms to the shape of the runner and are bendable at respective joint adjacent to the base plate, the bendable legs having end portions, one of the bendable legs having a locking tab and the other bendable leg having a recess, the locking tab passing through the recess to lock the end portions relative to each other, the runner having cross member positioning slots located along its length and one of the pair of legs having a tab member adapted to pass through the positioning slot to secure the bracket member from movement along the runner.

2. A fixture bracket suspension assembly mounted directly to a drop ceiling runner having a stem and a base wall with a pair of flanges extending out from the stem in a generally inverted T shape, the flanges adapted to support ceiling tiles, the fixture bracket assembly comprising:

a screw having a head portion and a stem portion for supporting a suspension wire adapted to be mounted to a fixture;

a bracket having a base plate an opening through which the stem portion of the screw passes, the base plate having a top surface for supporting the head of the screw adjacent the base wall, the bracket having two spaced apart pair of opposing legs, each of the opposing legs having a shape that conforms to the shape of the flanges and stem of the runner and being adapted to end at a joint adjacent to the base plate and wrap around the runner to present minimal encumbrance to the runner and to support the base plate and the screw below th runner.

3. The assembly of claim 2 wherein each of the pairs of legs have end portions that are adapted to be locked together.

4. The assembly of claim 3 wherein one of the legs of each pair of legs has a locking tab stamped therefrom and the other leg has a recess stamped therein, and the locking tab passes through the recess to lock the end portions legs relative to each other.

5. The assembly of claim 4 wherein the stem of the runner has cross member positioning slots located along its length and one of the each of the two pair of legs has a tab member adapted to pass through one of the positioning slot to secure the bracket member from movement along the runner.

6. The assembly of claim 2 wherein the stem of the runner has cross member positioning slots located along its length and one of the each of the two pair of legs has a tab member adapted to pass through one of the positioning slot to secure the bracket member from movement along the runner.

7. A fixture bracket suspension assembly mounted directly to an inverted T shaped drop ceiling or, the runner having a pair of generally horizontal opposed flanges extending outwardly from the end of an upright stem portion, the assembly comprising:

a screw having a head portion and a stem portion for supporting a suspension wire adapted to be mounted to a fixture;

a bracket having a single base th an opening through which the stem portion of the screw passes, the base plate having a top surface for supporting the head of the screw, the bracket having at least one pair of bendable legs adapted to be wrapped around the runner to present minimal encumbrance to the runner and to support the base plate and the screw below the runner, each of the bendable legs having a first leg portion and a second leg portion, and each bendable leg being bendable at a respective joint adjacent to the base plate so that the first leg portions lie generally parallel to the corresponding runner flange and the second leg portions lie generally parallel to the runner stern portion.

8. The assembly of claim 7 wherein the bendable legs have end portions that arc adapted to be locked together.

9. The assembly of claim 8 wherein one of the bendable legs has a locking tab and the other bendable leg has a recess, wherein the locking tab passes through the recess to lock the legs relative to each other.

10. The assembly of claim 7 wherein the second leg portions are adapted to be locked together.

11. The assembly of claim 10 wherein one of the second leg portion has a locking tab and the other of the second leg portions has a recess, wherein the locking tab passes through the recess to lock the second leg portions relative to each other.

12. The assembly of claim 7 wherein the runner has positioning slots located along its length and one of the second leg portions has a tab member adapted to pass through one of the positioning slots to secure the assembly from movement along the runner.

13. A fixture bracket suspension assembly for mounting to an inverted T shaped drop ceiling runner, the runner having a pair of generally horizontal opposed flange portions extending outward from one end of an upright stern portion, the assembly comprising:

a bracket having a single base portion with a top surface and a passage centrally located therein for receiving a screw head to support a fixture;

at least one pair of bendable legs adapted to be bent relative to the base plate portion from an open runner-receiving orientation to a closed runner-engaging orientation, each leg having a first leg portion being bendable at a respective joint adjacent to the base plate portion and a second leg portion extending from the first leg portion wherein, in the closed runner-engaging orientation, the first leg portion engages the corresponding runner horizontal flange portion and the second leg portion engages the runner stem portion, the second leg portions being her arranged to be locked together in the closed runner-engaging orientation to form a nested relationship between the legs and the runner.

14. The assembly of claim 13 wherein the second leg portion extends substantially at a right angle relative to the first leg portion.

15. The assembly of claim 14 wherein, in the closed runner-engaging orientation, the first leg portions are substantially parallel with the runner horizontal flange portions and the base plate portion.

16. The assembly of claim 15 each second leg portion having an inner region and an outer region wherein, in the closed runner-engaging orientation, the inner region is substantially parallel with a corresponding lower region of the stern portion and the outer region is substantially with a corresponding upper region of the stem portion.

17. The assembly of claim 13 wherein one of the legs has a locking tab and the other leg has a recess, the locking tab being arranged to pass through the recess to lock the second leg portions relative to each other.

18. The assembly of claim 13 wherein the runner stem portion has cross member positioning slots located along its length, and wherein one of the legs has a tab member adapted to pass through one of the positioning slots to secure the bracket member relative to the runner.

* * * * *

UNITED STATES PATENT AND TRADEMARK OFFICE

CERTIFICATE OF CORRECTION

PATENT NO. : 6,637,710 B2
DATED : October 28, 2003
INVENTOR(S) : Howard Yaphe and Pascal Toupin It is certified that error appears in the above-identified patent and that said Letters Patent is hereby corrected as shown below:

Column 3,
Line 15, replace “below e” with -- below the --;
Line 15, replace “iii” with -- in --;
Line 22, replace “to” with -- top --;

Column 4,
Line 2, replace “air” with -- pair --;
Line 7, after “bendable at” insert -- a --;
Line 25, after “plate” insert -- with --;
Line 31, replace “end” with -- bend --;
Line 34, replace “below th” with -- below the --;
Line 54, after “ceiling” delete “or” and insert -- runner. --;
Line 56, after “from” delete “the” and insert -- one --;
Line 61, delete “single”
Line 61, after “base” delete “th” and insert -- plate with --;

Column 5,
Line 28, replace “outward” with -- outwardly --;
Line 30, after “having a” delete “single”;
Line 30, after “base” insert -- plate --;

Column 6,
Line 8, replace “her” with -- further --;
Line 23, after “substantially” insert -- parallel --.

Signed and Sealed this

Ninth Day of March, 2004

JON W. DUDAS
*Acting Director of the United States Patent and Trademark Office*